US010760019B2

(12) United States Patent
Berkhous et al.

(10) Patent No.: US 10,760,019 B2
(45) Date of Patent: Sep. 1, 2020

(54) ADVANCED COMBUSTION FUEL COMPOSITIONS

(71) Applicant: ExxonMobil Research and Engineering Company, Annandale, NJ (US)

(72) Inventors: Scott K. Berkhous, Mickleton, NJ (US); Krystal B. Wrigley, Turnersville, NJ (US); Matthew I. Watkins, Mickleton, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 89 days.

(21) Appl. No.: 15/831,639

(22) Filed: Dec. 5, 2017

(65) Prior Publication Data

US 2018/0187109 A1 Jul. 5, 2018

Related U.S. Application Data

(60) Provisional application No. 62/439,952, filed on Dec. 29, 2016.

(51) Int. Cl.

| | |
|---|---|
| ***C10L 1/06*** | (2006.01) |
| ***C10L 1/04*** | (2006.01) |
| ***C10L 1/08*** | (2006.01) |

(52) U.S. Cl.
CPC ..... *C10L 1/06* (2013.01); *C10L 1/04* (2013.01); *C10L 1/08* (2013.01); *C10L 2200/0415* (2013.01); *C10L 2290/24* (2013.01)

(58) Field of Classification Search
CPC combination set(s) only.
See application file for complete search history.

(56) References Cited

U.S. PATENT DOCUMENTS

| | | | | |
|---|---|---|---|---|
| 2007/0175090 | A1* | 8/2007 | Haan | C10L 1/026 44/400 |
| 2009/0013590 | A1* | 1/2009 | Lamprecht | C10G 2/00 44/436 |
| 2009/0288337 | A1* | 11/2009 | Picataggio | C10L 1/02 44/449 |
| 2018/0134975 | A1* | 5/2018 | Choi | C10L 1/06 |

* cited by examiner

*Primary Examiner* — Ellen M McAvoy
*Assistant Examiner* — Chantel L Graham
(74) *Attorney, Agent, or Firm* — Robert A. Migliorini

(57) ABSTRACT

Fuel compositions for advanced combustion engines that include a naphtha boiling range portion are provided, where the fuel compositions can have a reduced ignition delay and/or an improved derived cetane number. The improved combustion properties can be achieved by adding a portion of a light naphtha (boiling range) composition to a heavy naphtha boiling range composition. The addition of up to about 10 vol % of a light naphtha composition to a heavy naphtha composition can result in a mixture having a reduced ignition delay relative to the heavy naphtha composition.

16 Claims, 6 Drawing Sheets

| D6730 - DHA - Light Naphtha (mass%) | | | | | | | |
|---|---|---|---|---|---|---|---|
| | Paraffins | I-Paraffins | Olefins | Napthenes | Aromatics | Unknowns | Total |
| C3 | 0.06 | 0.00 | 0.00 | 0.00 | 0.00 | 0.00 | 0.06 |
| C4 | 2.01 | 0.04 | 0.00 | 0.00 | 0.00 | 0.00 | 2.05 |
| C5 | 20.14 | 25.24 | 0.01 | 1.28 | 0.00 | 0.00 | 46.67 |
| C6 | 7.68 | 13.15 | 0.03 | 7.72 | 1.17 | 0.00 | 29.74 |
| C7 | 2.60 | 4.69 | 0.26 | 6.85 | 1.60 | 0.00 | 16.00 |
| C8 | 0.61 | 2.09 | 0.14 | 1.00 | 0.57 | 0.01 | 4.43 |
| C9 | 0.11 | 0.46 | 0.00 | 0.17 | 0.15 | 0.01 | 0.89 |
| C10 | 0.02 | 0.03 | 0.00 | 0.00 | 0.08 | 0.00 | 0.13 |
| C11 | 0.00 | 0.01 | 0.00 | 0.00 | 0.01 | 0.00 | 0.02 |
| C12 | 0.00 | 0.00 | 0.00 | 0.00 | 0.01 | 0.00 | 0.01 |
| C13 | 0.00 | 0.00 | 0.00 | 0.00 | 0.00 | 0.00 | 0.00 |
| Total: | 33.23 | 45.71 | 0.45 | 17.02 | 3.57 | 0.02 | 100.00 |

FIG. 2

| D6730 - DHA - Heavy Naphtha (mass%) | | | | | | | |
|---|---|---|---|---|---|---|---|
| | Paraffins | I-Paraffins | Olefins | Napthenes | Aromatics | Unknowns | Total |
| C3 | 0.00 | 0.00 | 0.00 | 0.00 | 0.00 | 0.00 | 0.00 |
| C4 | 0.00 | 0.00 | 0.00 | 0.00 | 0.00 | 0.00 | 0.00 |
| C5 | 0.00 | 0.00 | 0.00 | 0.00 | 0.00 | 0.00 | 0.00 |
| C6 | 0.01 | 0.01 | 0.00 | 0.01 | 0.00 | 0.00 | 0.03 |
| C7 | 0.01 | 0.02 | 0.00 | 0.06 | 0.02 | 0.00 | 0.11 |
| C8 | 0.29 | 11.27 | 0.17 | 0.73 | 0.26 | 0.00 | 12.73 |
| C9 | 1.82 | 5.61 | 0.42 | 4.47 | 13.75 | 0.13 | 26.20 |
| C10 | 2.30 | 12.79 | 1.51 | 3.08 | 15.22 | 1.02 | 35.92 |
| C11 | 2.84 | 6.72 | 0.31 | 1.13 | 1.95 | 1.91 | 14.86 |
| C12 | 1.27 | 0.77 | 0.00 | 0.24 | 1.42 | 4.05 | 7.75 |
| C13 | 0.62 | 0.08 | 0.02 | 0.00 | 0.00 | 0.87 | 1.61 |
| Total: | 9.17 | 37.26 | 2.44 | 9.73 | 32.63 | 7.98 | 99.20 |

FIG. 3

ADVANCED COMBUSTION FUEL COMPOSITIONS

CROSS-REFERENCE TO RELATED APPLICATIONS

This application claims the benefit of U.S. Provisional Application No. 62/439,952, filed on Dec. 29, 2016, the entire contents of which are incorporated herein by reference.

FIELD

Fuel compositions with improved ignition properties and methods for making such fuel compositions are provided.

BACKGROUND

Internal combustion engines can typically be characterized as corresponding to one of two types of engines. In spark-ignited internal combustion engines, a mixture of fuel and air is compressed without causing ignition or combustion of the air/fuel mixture based just on compression. A spark is then introduced into the air fuel mixture to start combustion at a desired timing.

The other typical type of engine is a compression ignition engine. In compression ignition, combustion air is compressed in the cylinder, resulting in an increase in the temperature and pressure of the air. Fuel is injected into the hot compressed combustion air and auto-ignition occurs. A fuel for a compression ignition engine can be characterized based on a cetane number, which is a measure of how quickly a fuel will ignite. Many conventional compression ignition engines use kerosene and/or diesel boiling range compositions as fuels. However, some compression ignition engines can use naphtha boiling range compositions as fuels. Examples of advanced combustion engines that can use naphtha boiling range fuel compositions include, but are not limited to, homogenous charge compression ignition (HCCI) engines and pre-mixed charge compression ignition (PCCI) engines.

Spark ignition engines can have improved operation when operated with a fuel that provides a sufficient ignition delay so that the start of combustion is substantially controlled by the introduction of a spark into the combustion chamber. Fuels that do not have a sufficient ignition delay for an engine can cause "knocking" in the engine, where at least part of the combustion in the engine is not dependent on the introduction of the spark into the combustion chamber.

Traditionally, fuels for spark ignition engines have been characterized based on use of octane ratings, which is a measure of the ability of a fuel to resist combustion based solely on compression. The octane rating is valuable information for a spark-ignited engine, as the octane rating indicates what type of engine timings may be suitable for use with a given fuel. A common method for characterizing the octane rating of a fuel is to use an average of the Research Octane Number (RON—ASTM D2699) and the Motor Octane Number (MON—ASTM D2700) for a composition. (RON+MON/2). This type of octane rating can be used to determine the likelihood of "knocking" behavior when operating a conventional spark ignition engine.

Another type of characterization of a fuel for a spark ignition engine is the sensitivity of the fuel, which is defined as (RON−MON). Some previous methods for selecting fuels with longer ignition delays at a given value of RON have involved selecting fuels with lower values of the sensitivity.

SUMMARY

In various aspects, a fuel composition is provided comprising a derived cetane number of about 27 to about 43. The fuel composition can comprise a T5 distillation point of about 20° C. to about 60° C., a T10 distillation point of about 50° C. to about 120° C., a T15 distillation point of about 90° C. to about 140° C., and/or a T95 distillation point of about 275° C. or less.

Optionally, the boiling ranges of the fuel composition can be further defined. For example, in some aspects the T5 distillation point can be about 20° C. to about 40° C., the T10 distillation point can be about 50° C. to about 80° C., and the T15 distillation point can be about 90° C. to about 120° C.; or the T5 distillation point can be about 30° C. to about 50° C., the T10 distillation point can be about 60° C. to about 100° C., and the T15 distillation point can be about 100° C. to about 140° C.; or the T5 distillation point can be about 40° C. to about 60° C., the T10 distillation point can be about 70° C. to about 120° C., and the T15 distillation point can be about 100° C. to about 140° C. Additionally or alternately, the T95 distillation point can be about 204° C. or less, or the T95 distillation point can be about 204° C. to about 250° C., or about 204° C. to 232° C., or about 220° C. to about 250° C.

In some aspects, the fuel composition can have a derived cetane number of at least about 30. Additionally or alternately, the fuel composition can comprise a chemical delay, as determined by ASTM D7668, of 5.0 milliseconds or less, a physical delay of 8 milliseconds to 20 milliseconds, or a combination thereof.

In various aspects, method for forming a fuel composition is provided. The method can include mixing a first composition comprising a light naphtha portion with a second composition comprising a heavy naphtha portion to form the fuel composition, the fuel composition comprising a derived cetane number of 27 to 43. The fuel composition can comprise 0.1 vol % to 10 vol % of the first composition, wherein the first composition can have a T5 distillation point of at least about 10° C. and a T95 distillation point of about 110° C. or less, and the second composition can have a T5 distillation point of at least about 90° C. and a T95 distillation point of about 275° C. or less.

Optionally, the boiling ranges of the fuel composition can be further defined. For example, in some aspects the T5 distillation point can be about 20° C. to about 40° C., the T10 distillation point can be about 50° C. to about 80° C., and the T15 distillation point can be about 90° C. to about 120° C.; or the T5 distillation point can be about 30° C. to about 50° C., the T10 distillation point can be about 60° C. to about 100° C., and the T15 distillation point can be about 100° C. to about 140° C.; or the T5 distillation point can be about 40° C. to about 60° C., the T10 distillation point can be about 70° C. to about 120° C., and the T15 distillation point can be about 100° C. to about 140° C. Additionally or alternately, the T95 distillation point can be about 204° C. or less, or the T95 distillation point can be about 204° C. to about 250° C., or about 204° C. to 232° C., or about 220° C. to about 250° C.

In some aspects, the fuel composition can comprise 1.0 vol % to 10 vol % of the first composition, or 1.0 vol % to 5.0 vol %, or 3.0 vol % to 10 vol %, or 3.0 vol % to 5.0 vol %; or the fuel composition can comprise 0.1 vol % to 3.0 vol % of the first composition, or 0.1 vol % to 2.0 vol %, or 0.1 vol % to 1.0 vol %.

In some aspects, the fuel composition can have a T5 distillation point of at least about 90° C., or at least about 100° C. In some aspects, the T95 distillation point can be about 204° C. or less, or the T95 distillation point can be about 204° C. to about 250° C., or about 204° C. to 232° C., or about 220° C. to about 250° C. Optionally, the fuel composition can have a derived cetane number of at least about 30.

In some aspects, the first composition can have an aromatics content of about 10 vol % or less and the second composition has an aromatics content of about 15 vol % to about 40 vol %.

In some aspects, the fuel composition can have a chemical delay as determined by ASTM D7668 of less than 5.0 milliseconds, a physical delay of 8 milliseconds to 20 milliseconds, or a combination thereof; and/or the fuel composition can have a chemical delay as determined by ASTM D7668 that is less than a chemical delay of the second composition.

BRIEF DESCRIPTION OF THE DRAWINGS

FIG. 2 shows compositional details for a light naphtha composition.

FIG. 3 shows compositional details for a heavy naphtha composition.

DETAILED DESCRIPTION

Overview

Figure 1:
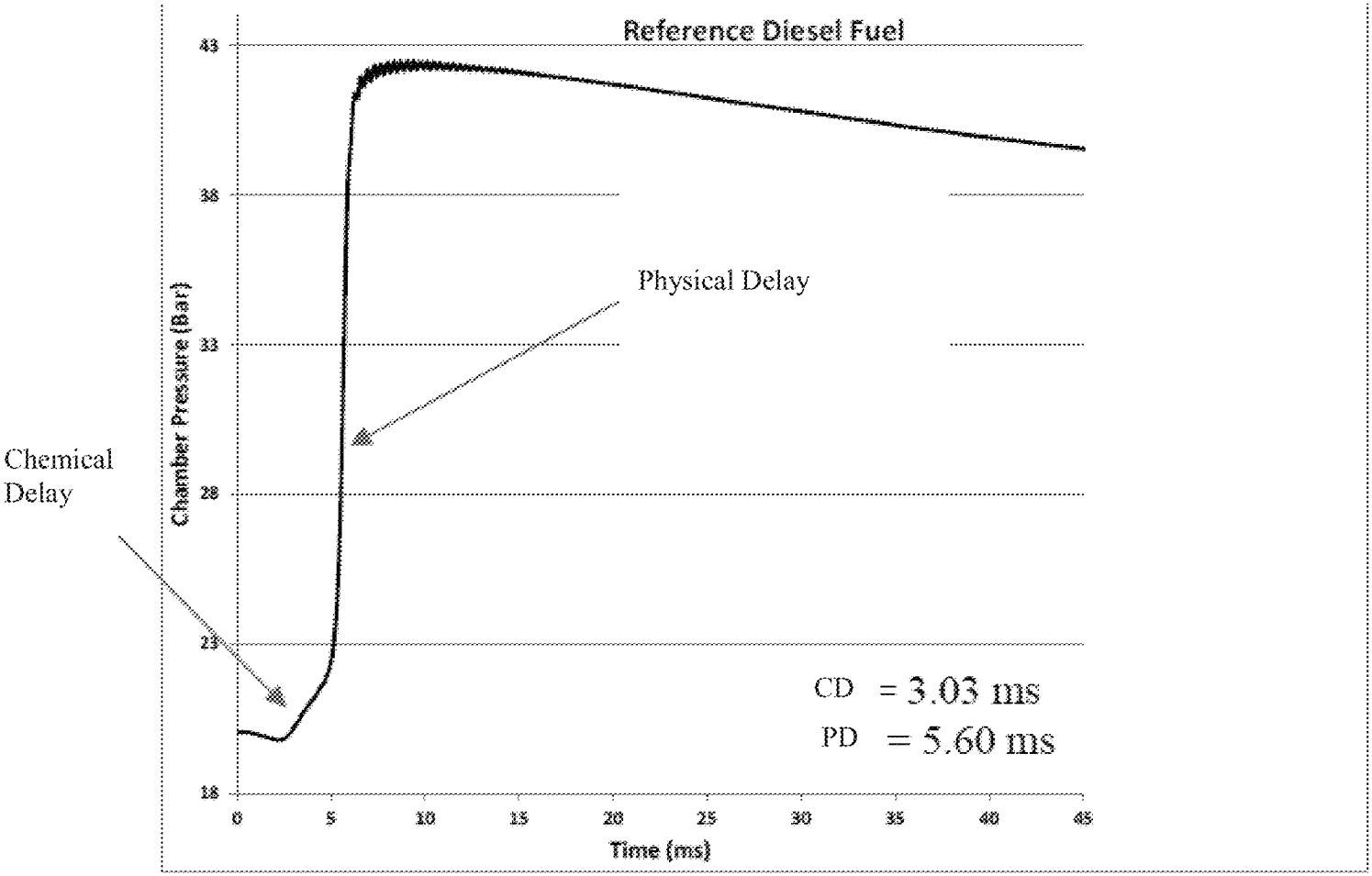
FIG. 1 shows a pressure versus time curve for determining ignition delay according to ASTM D7668 for a typical diesel fuel composition.

In various aspects, fuel compositions for advanced combustion engines that include a naphtha boiling range portion are provided, where the fuel compositions can have a reduced ignition delay (based on a reduced chemical delay) and/or the fuel compositions can have an improved derived cetane number. The improved combustion properties can be achieved by adding a portion of a light naphtha (boiling range) composition to a heavy naphtha boiling range composition. The addition of up to about 10 vol % of a light naphtha composition to a heavy naphtha composition can result in a mixture having a reduced ignition delay (such as a reduced chemical delay) relative to the heavy naphtha composition.

Typical "high volatility" fuels such as E10 gasoline or other naphtha boiling range streams can pose a variety of challenges for use in advanced combustion engines. Some issues can be related to a lack of sufficient lubricity and/or viscosity for high pressure fuel injection systems, although this can be partially overcome by engine design. Other difficulties can be related to the long ignition delay times for such fuels, which can result in a combustion reaction that involves a relatively longer period of time for pre-mixing followed by a relatively short combustion time. This can increase the difficulty in reliably controlling the timing of combustion, which can lead to knocking behavior. In order to overcome this difficulty, naphtha boiling range fuel compositions for advanced combustion engines can traditionally be limited to heavy naphthas. It is believed that use of heavy naphthas can provide additional control over combustion timing while still providing sufficient volatility to allow for some air/fuel mixing. Heavy naphthas can correspond to a fuel composition that has a T5 boiling point of at least about 90° C., or at least about 100° C. Additionally or alternately, such a heavy naphtha composition can have an initial boiling point of at least about 55° C., or at least about 60° C. Additionally or alternately, such a heavy naphtha composition can include less than about 1 wt % of compounds with a boiling point of less than 60° C. Optionally, a heavy naphtha can have a T95 boiling point of about 232° C. or less, or about 204° C. or less. Optionally, a heavy naphtha can have a final boiling point of about 232° C. or less, or about 204° C. or less. In particular, a heavy naphtha can have a T5 to T95 boiling range of about 80° C. to about 232° C., or about 100° C. to about 232° C., or about 80° C. to about 204° C.

It has been unexpectedly discovered that addition of a light naphtha fraction and/or one or more light naphtha boiling range components to a heavy naphtha composition can result in a combined fuel composition with an improved derived cetane number relative to the derived cetane number for the heavy naphtha composition. Without being bound by any particular theory, it is believed that for light naphtha concentrations of 10 vol % or less (or 5 vol % or less, or 3 vol % or less), the increased volatility of the light naphtha can result in improved compression ignition performance. The light naphtha compounds can more easily evaporate when injected into a combustion chamber and/or can mix with combustion air more rapidly than the higher boiling compounds in a heavy naphtha. This faster fuel/air interaction can allow chemical reactions to take place sooner, which can lead to a shorter chemical delay for the start of combustion. However, as the amount of light naphtha continues to increase, the reduced energy density of the light naphtha can lead to a decrease in the fuel density. At concentrations above 3 vol % or above 5 vol % or above 10 vol %, the decrease in fuel density can offset the reduction in chemical delay (due in part to less mass of fuel being injected into the engine), resulting in the expected reduction in cetane rating as further light naphtha is added to a heavy naphtha. It is noted that this effect is not observed if a light naphtha is mixed with a fuel composition that includes a substantial portion of diesel boiling range material, such as a composition that has a T95 distillation point of greater than about 275° C.

Both octane rating (such as RON) and cetane rating are values that can provide some indication of the ignition delay of a fuel composition. Octane rating is typically used for spark ignition engines, where increased ignition delay is desirable. Knocking" typically occurs after spark when the premixed air and fuel charge begins to burn. The increased pressure and temperature in the cylinder from the burning fuel causes a localized spontaneous combustion event. The spark ignited flame front does not propagate smoothing through the air/fuel charge. Instead, spontaneous ignition causes rapid pressure increase resulting in an audible knocking sound. Typically this can be due to a portion of the fuel/air mixture combusting prior to encountering the spark and/or the combustion front initiated by a spark. A fuel composition with an increased ignition delay, when used in a spark ignition engine, can correspond to a fuel composition with an increased knock resistance. Cetane rating is typically used for compression ignition engines, where a reduced ignition delay can be beneficial. In compression ignition, combustion is controlled by when the fuel is injected. Fuels with shorted ignition delay times are generally desirable as they are easier to predict/control when combustion occurs.

Naphtha Fuel Compositions with Reduced Ignition Delay

In this discussion and the claims below, references to fractional distillation points, such as T5 (temperature at which 5 vol % is distilled) can be determined according to ASTM D2887 (simulated distillation) or ASTM D86 (if D2887 is not suitable for some reason).

In this discussion, the naphtha boiling range is defined as about 50° F. (~10° C., roughly corresponding to the lowest boiling point of a pentane isomer) to 450° F. (~233° C.). It is noted that due to practical consideration during fractionation (or other boiling point based separation) of hydrocarbon-like fractions, a fuel fraction formed according to the methods described herein may have a T5 or a T95 distillation point corresponding to the above values, as opposed to having initial/final boiling points corresponding to the above values. Compounds ($C_{4-}$) with a boiling point below the naphtha boiling range can be referred to as light ends. In some aspects, a naphtha boiling range fuel composition can have a lower final boiling point and/or T95 distillation point, such as a final boiling point and/or T95 distillation point of about 450° F. (~232° C.) or less, or about 400° F. (~204° C.) or less, or about 380° F. (~193° C.) or less, or about 360° F. (~182° C.) or less, such as down to about 160° C. Optionally, a naphtha boiling range fuel composition can have a higher T5 distillation point, such as a T5 distillation point of at least about 10° C., or at least about 20° C., or at least about 30° C., such as up to about 50° C. In particular, a naphtha boiling range fuel composition can have a T5 of at least 10° C. and a T95 of 232° C. or less, or a T5 of at least 15° C. and a T95 of 220° C. or less, or a T5 of at least 20° C. and a T95 of 204° C. or less.

In addition to defining the total naphtha boiling range, a boiling range for a light naphtha and a heavy naphtha can be specified. A light naphtha can have a T5 distillation point of at least about 10° C., or at least about 20° C., or at least about 25° C., or at least about 30° C. Such a light naphtha can have a T95 distillation point of about 100° C. or less, or about 90° C. or less, or about 80° C. or less. In particular, a light naphtha can have a boiling range corresponding to a T5 distillation point of at least 10° C. to a T95 distillation point of 100° C. or less, or a T5 distillation point of at least 25° C. to a T95 distillation point of 80° C. or less, or a T5 distillation point of at least 30° C. to a T95 distillation point of 100° C. or less. It is noted that 10° C. is roughly the boiling point of neopentane, while 25° C. is roughly the boiling point of isopentane. A heavy naphtha can have a T5 distillation point of at least about 90° C., or at least about 100° C., or at least about 110° C., or at least about 120° C. Such a heavy naphtha can have a T95 distillation point of about 232° C. or less, or about 220° C. or less, or about 204° C. or less, or about 190° C. or less. In particular, a heavy naphtha can have a boiling range corresponding to a T5 distillation point of at least 90° C. to a T95 distillation point of 232° C. or less, or a T5 distillation point of at least 100° C. to a T95 distillation point of 204° C. or less, or a T5 distillation point of at least 90° C. to a T95 distillation point of 190° C. or less.

In some aspects, a fuel composition that includes a heavy naphtha portion can correspond to a heavy naphtha boiling range composition. In some aspects, a fuel composition that includes a heavy naphtha portion can also include a portion that boils above the naphtha boiling range. In such aspects, the final boiling point and/or the T95 distillation point for a fuel composition that includes a heavy naphtha portion can be about 275° C. or less, or about 260° C. or less, or about 250° C. or less.

In some aspects, a composition including a light naphtha portion can also include a portion that boils above the light naphtha boiling range. In such aspects, the final boiling point for the composition that includes the light naphtha portion can be about 150° C. or less, or about 130° C. or less. Additionally or alternately, the T95 distillation point for such a composition can be about 120° C. or less, or about 110° C. or less.

Optionally, a composition including a light naphtha portion can have a different type of compositional distribution than a heavy naphtha composition. For example, in some aspects the aromatics content of a composition including a light naphtha portion can be about 10 vol % or less, or about 5 vol % or less, or about 2 vol % or less, such as down to substantially no aromatics (i.e., ~0 vol %). In particular, the aromatics content of the light naphtha portion can be 0 vol % to 10 vol %, or 0.1 vol % to 10 vol %, or 0.1 vol % to 5 vol %, or 0 vol % to 2 vol %. This can be in contrast to a composition including a heavy naphtha portion, which in some aspects can optionally have an aromatics content of 15 vol % to 40 vol %. In various aspects, the heavy naphtha portion of a mixture can have a derived cetane number of about 27 to about 43, or about 30 to about 43 prior to addition of the light naphtha.

Optionally, the light naphtha portion can correspond to a mixture of paraffins, such as a mixture of $C_4$ to $C_6$ paraffins, or a mixture of $C_5$ to $C_6$ paraffins, or a mixture of $C_5$ paraffins, or a mixture of $C_6$ paraffins. Optionally, in addition to having a low content of aromatics, in some aspects a light naphtha composition can be substantially free of ethanol and/or other components containing 3 or fewer carbons. This can correspond to having an ethanol content (and/or content of components with 3 or fewer carbons) of 2.0 vol % or less, 1.0 vol % or less, or 0.5 vol % or less, or 0.1 vol % or less, such as down to 0 vol %.

For fuel compositions having a reduced ignition delay (corresponding to a reduced chemical delay) as described here, the boiling range profile of the fuel composition can be similar to a heavy naphtha, but with an extended tail including light naphtha. As a result, a fuel composition as described herein can have a larger amount of low boiling compounds than would be expected for a conventional heavy naphtha fraction, while also having a smaller amount of low boiling compounds than would be expected for a full boiling range gasoline. A fuel composition as described herein can also have a shorter ignition delay than a typical gasoline for a spark ignition engine.

In various aspects, the physical delay portion of the ignition delay for a fuel composition can be less than the combustion stroke of a corresponding advanced combustion engine that makes use of the fuel composition. For example, for typical operation at 1500 rpm, a 4 stroke advanced combustion engine can have a combustion stroke of approximately 20 milliseconds. Therefore, the physical delay for a mixture of light naphtha and heavy naphtha (fuel composition) as described herein can be from 8 milliseconds to 20 milliseconds, or 8 milliseconds to 16 milliseconds, or 8 milliseconds to 14 milliseconds. Additionally or alternately, the chemical delay of a fuel composition as described herein can be shorter than the chemical delay of a light naphtha composition. In some aspects, the chemical delay portion of the ignition delay can be 5.0 milliseconds or less.

In some aspects, a fuel composition as described herein can have a distillation profile similar to a heavy naphtha. When the amount of light naphtha added to the heavy naphtha is about 3 vol % or less, or about 1 vol % or less, the distillation profile of the mixed composition can appear to be similar to a heavy naphtha. In such aspects, the T5 distillation point for the fuel composition can be at least about 90° C., or at least about 100° C., while the T95 distillation point can be about 275° C. or less, or about 250° C. or less, or about 232° C. or less.

In other aspects where more than 3 vol % of light naphtha is introduced into a fuel composition, the fuel composition can have a T5 distillation point of about 20° C. to about 60° C., or about 20° C. to about 50° C., or about 20° C. to about 40° C., or about 30° C. to about 60° C., or about 30° C. to about 50° C., or about 40° C. to 60° C. Additionally or alternately, a fuel composition as described herein can have a T10 distillation point of about 50° C. to about 80° C., or about 60° C. to about 100° C., or about 70° C. to about 120° C. Additionally or alternately, a fuel composition as described herein can have a T15 distillation point of about 90° C. to about 120° C., or about 100° C. to about 130° C., or about 110° C. to about 140° C. A fuel composition having such T5 and/or T10 and/or T15 distillation points can also have a T95 distillation point of about 275° C. or less, or about 250° C. or less, or about 232° C. or less, if the fuel composition includes an expanded heavy naphtha portion, or the fuel composition can have a T95 distillation point of about 232° C. or less, or about 220° C. or less, or about 204° C. or less, or if the heavy naphtha portion of the fuel composition corresponds to an expanded heavy naphtha, the fuel composition can have a T95 distillation point of about 275° C. or less, or about 250° C. or less, or about 232° C. or less.

In various aspects, a fuel composition having a reduced ignition delay can be formed by adding a suitable amount of a light naphtha to a heavy naphtha. Optionally, the heavy naphtha can include a diesel portion, and in such optional aspects the T95 distillation point of the heavy naphtha can be 275° C. or less, or 250° C. or less. The amount of light naphtha added to the heavy naphtha can be from about 0.1 vol % to about 10 vol %, or about 0.5 vol % to about 10 vol %, or about 0.5 vol % to about 5.0 vol %, or about 1.0 vol % to about 10 vol %, or about 1.0 vol % to about 5.0 vol %. For aspects where it is desired to provide a fuel composition that substantially matches the heavy naphtha boiling range, the amount of light naphtha added to the heavy naphtha can be from about 0.1 vol % to about 2.0 vol %, or about 0.1 vol % to about 1.0 vol %, or about 0.5 vol % to about 3.0 vol %, or about 0.2 vol % to about 1.0 vol %. For aspects where it is desired produce a fuel composition with a distillation profile different from the heavy naphtha boiling range, the amount of light naphtha added to the heavy naphtha can be about 2.0 vol % to about 10 vol %, or about 3.0 vol % to about 10 vol %, or about 2.0 vol % to about 5.0 vol %, or about 3.0 vol % to about 5.0 vol %.

In some aspects, a fuel composition can further include one or more additives, such as additives to enhance one or more aspects or properties of the fuel composition. Examples of suitable additives can include antifoam additives, antioxidants, biocides, cetane improvers, cold flow improvers, corrosion inhibitors, demulsifiers, detergents, dyes, lubricity improvers, markers, and metal deactivators. The one or more additives can include any convenient combination of additives to achieve a fuel composition having a desired property or properties. Although additives can be included in a fuel composition, in some aspects the fuel compositions described herein can correspond to fuel compositions that consist essentially of naphtha, and therefore contain substantially no additives.

In some aspects, a fuel composition can further include one or more bio-derived fuel components. Examples of suitable bio-derived fuel components can include, but are not limited to, ethanol, biodiesel, fatty acid methyl esters (and/or other fatty acid alkyl esters), renewable diesel, bio-derived alcohols, and/or other alcohols.

It is noted that the apparent derived cetane number of a mixture of light naphtha and heavy naphtha may appear to continue to increase for amounts of light naphtha greater than about 10 vol %. However, for such mixtures, the apparent increase in derived cetane number is not related to a reduction of both the chemical delay and physical delay portions of the ignition delay. Instead, for mixtures including about 20 vol % or more of a light naphtha, the chemical delay portion of the ignition delay can be greater than the chemical delay of the corresponding heavy naphtha. For such mixtures, the physical delay portion of the ignition delay may still be lower than the physical delay of the corresponding heavy naphtha. For such mixtures, Equation (1) for determining the derived cetane number may appear to yield an increase in the cetane value. However, due to the combination of increased chemical delay and reduced physical delay, it is unclear whether such mixtures would provide an actual increase in cetane number as determined by ASTM D613, as it can be difficult to differentiate between small changes in chemical delay using the ASTM D613 Cetane engine. The alternative method for determining ignition delay provided below can take advantage of the ability of the Cetane ID 510 analyzer to provide high speed data acquisition, which can provide sufficient resolution in the pressure curves to identify small differences in the chemical delay.

Determining Ignition Delay: Chemical Delay, Physical Delay, and Derived Cetane Number In this discussion, ignition delays and/or derived cetane numbers were determined using a Cetane ID 510 constant volume combustion chamber, available from PAC, LP of Houston, Tex. Briefly, during a test of a potential fuel composition, a combustion chamber can be charged with air at a specified pressure. The air in the chamber can then be heated to a desired set point temperature for the test. The chamber can be held at a substantially constant temperature/constant pressure at that point until fuel is introduced into the chamber. Fuel can then be injected into the chamber for a predetermined amount of time, such as an amount of time that corresponds to a desired amount of fuel for injection. An analyzer can measure pressure as function of time after injection of the fuel. Combustion could start during injection, but typically combustion does not start until after completing the injection of the fuel.

In this discussion and the claims below, ignition delays and/or derived cetane numbers were determined according to the methods in ASTM D7668. Ignition delays as defined in ASTM D7668 can correspond to chemical delay and physical delay. The chemical delay and physical delay can be better understood with reference to FIG. 1, which shows an example of a typical pressure versus time curve for a conventional diesel fuel that was determined using a Cetane ID 510. Under the method in ASTM D7668, the chemical delay can be calculated as the time required (after initial injection of fuel) for the pressure to increase to 0.2 MPa above the injection pressure. This is believed to correspond to the physical start of combustion reactions (i.e., generation of free radicals). As shown in FIG. 1, a brief drop in pressure often occurs prior to the pressure increasing to 0.2 MPa above the injection pressure. The physical delay can be calculated based on the time between initial injection of fuel and a large rise in pressure corresponding to bulk combustion. In this discussion, the physical delay is defined as the time to reach 50% of maximum pressure in the pressure versus time curve.

Based on the chemical delay and physical delay, a correlation equation can be used to calculate the derived cetane number for a fuel composition. The correlation equation is shown in Equation (1). In Equation (1), "DCN" is derived cetane number, "CD" is the chemical delay (milliseconds), and "PD" is the physical delay (milliseconds). It is noted that the Cetane ID 510 instrument may use different names or identifiers to refer to these variables.

$$DCN=13.028+(-5.3378/CD)+(300.18/PD)+(-1267.90/PD^2)+(3415.32/PD^3) \quad (1)$$

Although the chemical delay and physical delay are measured independently, the chemical delay and physical delay values are correlated together and tend to move in the same direction. In other words, a decrease in chemical delay time can tend to result in a decrease in the physical delay time as well. Based on the nature of Equation (1), a shorter chemical delay and/or physical delay can result in a higher derived cetane number. A higher derived cetane number indicates improved combustion quality under compression ignition conditions. The chemical delay (designated CD) corresponds to the initial onset of chemical reactions—generation of free radicals. In other references, this is referred to the low temperature heat release. Once a sufficient "pool" of free radicals has accumulated, the bulk combustion even takes place. This is related to the physical delay (PD) measurement.

EXAMPLE 1

Characterization of Mixtures of Light Naphtha and Heavy Naphtha

Testing was performed to evaluate the combustion performance of various fuel compositions under compression ignition conditions. In addition to a reference diesel composition used to generate FIG. 1, a light naphtha and a heavy naphtha were also selected for testing. FIG. 2 shows a detailed compositional analysis of the light naphtha, while FIG. 3 shows a detailed compositional analysis of the heavy naphtha.

Based on the compositional data shown in FIG. 2 and FIG. 3, it is conventionally expected that the light naphtha composition would have a lower derived cetane number than the heavy naphtha composition. Based on the expected correlation of cetane number with ignition delay, it would therefore be conventionally expected that adding any amount of the light naphtha composition to the heavy naphtha composition would result in a mixed composition with a lower derived cetane number than the heavy naphtha composition. However, it has been unexpectedly discovered that adding 10 vol % or less, or 5 vol % or less, or 3 vol % or less of a light naphtha composition to a heavy naphtha composition can result in a mixed composition with a shorter chemical delay portion of the ignition delay than the heavy naphtha composition alone.

A series of compositions were formed by mixing a small amount of the light naphtha composition in FIG. 2 with the heavy naphtha composition in FIG. 3. Table 1 below shows the relative volume percent of the light naphtha composition in the mixed composition, along with results from characterizing the mixed compositions according to ASTM D7668 using a Cetane ID 510 analyzer. As shown in Table 1, the amount of the light naphtha composition used in the mixed compositions ranged from 0.25 vol % to 10 vol %. For additional comparison, samples were also analyzed corresponding to the heavy naphtha composition itself (no light naphtha) and a mixture including a 50 vol % of the light naphtha composition. Similar to Equation (1), CD in table 1 refers to the chemical delay, PD refers to the physical delay, and DCN refers to Derived Cetane Number. The values for CD and PD in Table 1 correspond to the delay in milliseconds.

TABLE 1

Combustion Data for Mixed Naphtha Compositions

| | Heavy Naphtha | Heavy Naphtha + 0.25% Light Naphtha | Heavy Naphtha + 0.50% Light Naphtha | Heavy Naphtha + 1.0% Light Naphtha | Heavy Naphtha + 3.0% Light Naphtha | Heavy Naphtha + 5.0% Light Naphtha | Heavy Naphtha + 10.0% Light Naphtha | Heavy Naphtha + 50.0% Light Naphtha |
|---|---|---|---|---|---|---|---|---|
| CD | 4.87 | 4.46 | 4.46 | 4.51 | 4.51 | 4.59 | 4.70 | 5.33 |
| PD | 11.47 | 11.04 | 11.17 | 11.09 | 11.00 | 10.85 | 11.03 | 11.04 |
| DCN | 30.70 | 31.16 | 30.99 | 31.11 | 31.23 | 31.44 | 31.23 | 31.35 |

As shown in Table 1, addition of 10 vol % or less of light naphtha to the heavy naphtha results in a mixed composition with an improved (shorter time length) chemical delay. At 0.25 vol %, the chemical delay is improved by roughly 7%. As further light naphtha is added, the improvement in chemical delay is reduced. This is believed to be due in part to the reduction in fuel density caused by adding increasing amounts of light naphtha. At higher proportions of light naphtha, such as at 50 vol % light naphtha, the chemical delay of the mixture is substantially greater than the chemical delay of the heavy naphtha.

EXAMPLE 2

Fuel Compositions for Additional Testing

To further investigate how chemical delay of a fraction is impacted by addition of small portions of a lower cetane value composition, various mixtures were formed using a representative gasoline, a light naphtha fraction, a heavy naphtha fraction, and a representative diesel fuel. Table 2 shows compositional data for the gasoline, diesel, and the naphtha fuel fractions.

TABLE 2

Fuel Composition Data

| | Gasoline | Light Naphtha | Heavy Naphtha | Reference Diesel |
|---|---|---|---|---|
| D6729 | | | | |
| n-Paraffins (Vol. %) | 21.3 | 34.8 | 12.5 | n/a |
| Isoparaffins (Vol. %) | 26.7 | 46.6 | 43.9 | n/a |
| Olefins (Vol. %) | 5.5 | 0 | 2.6 | n/a |
| Naphthenes (Vol. %) | 10.2 | 16 | 5 | n/a |
| Aromatics (Vol. %) | 25.9 | 2.6 | 30.6 | n/a |
| other | 10.4 | 0 | 5.4 | |
| D5580 Benzene Content (Vol. %) | 0.56 | 0.91 | 0 | n/a |
| D4815 Ethanol Content (Vol. %) | 9.91 | 0 | 0 | 0 |
| UOP 990 | | | | |
| n-Paraffins (Vol. %) | | | | 23.3 |
| Isoparaffins (Vol. %) | | | | 8.2 |
| Olefins (Vol. %) | | | | 0 |
| Naphthenes (Vol. %) | | | | 38.2 |
| Aromatics (Vol. %) | | | | 29.6 |
| other | | | | 0.7 |

EXAMPLE 3

Mixtures of Light Naphtha and Heavy Naphtha

Figure 4:
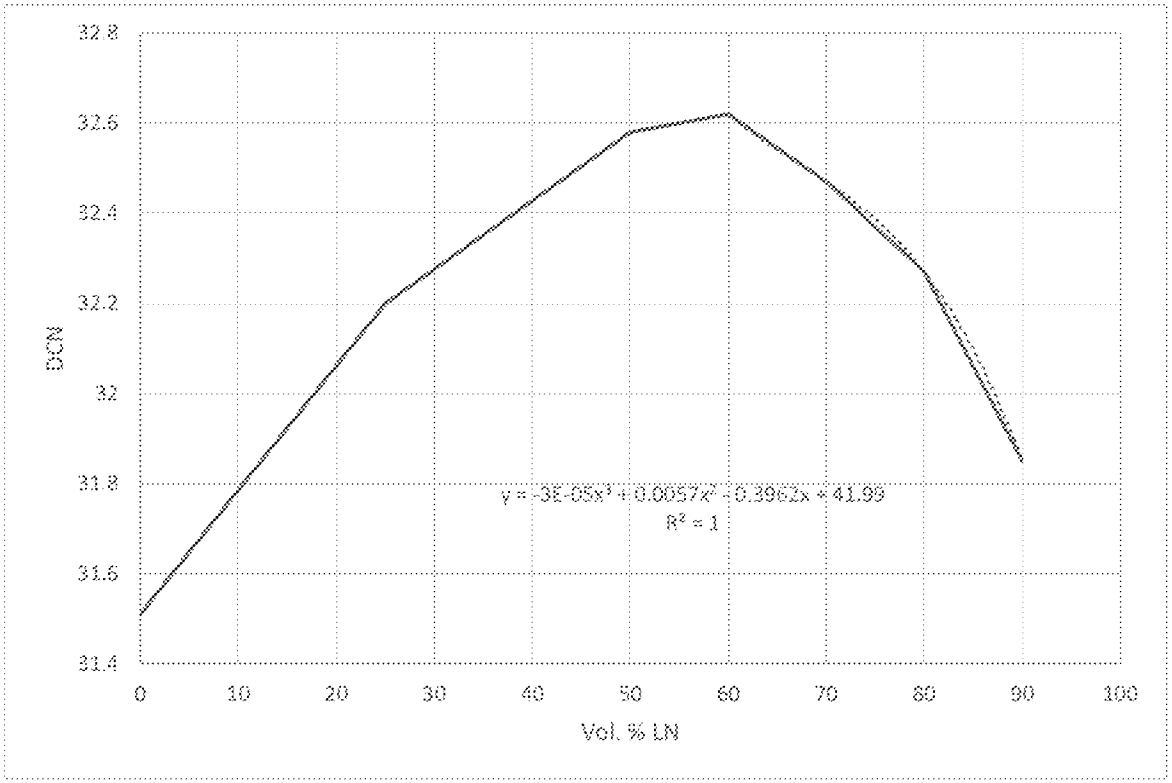
FIG. 4 shows derived cetane number values for various mixtures of a light naphtha with a heavy naphtha.

Additional experiments similar to those described in Example 1 were performed using the light naphtha and heavy naphtha fractions shown in Table 2, in an effort to determine a derived cetane number for a light naphtha sample. Due to the viscosity of light naphtha samples, the light naphtha in Table 2 (as well as the light naphtha in FIG. 2) could not be directly used in the Cetane 510ID analyzer for characterization according to ASTM D7668. Instead, a series of light naphtha and heavy naphtha blends was prepared, so that a cetane number for the light naphtha fraction could be extrapolated. It was determined that mixtures of up to 90 vol % light naphtha could be characterized. Table 3 shows the ignition delays (chemical delay and physical delay) determined for various blends of the light naphtha and heavy naphtha from Table 2. The derived cetane number values in Table 3 are also shown in FIG. 4.

TABLE 3

Measured Ignition Delays for Light Naphtha and Heavy Naphtha Blends

| Vol % Heavy Naphtha | Vol % Light Naphtha | Chemical Delay | Physical Delay | DCN |
|---|---|---|---|---|
| 10 | 90 | 5.6173 | 10.7001 | 31.85 |
| 20 | 80 | 5.2098 | 10.3398 | 32.27 |
| 30 | 70 | 5.0328 | 10.1745 | 32.47 |
| 40 | 60 | 4.8896 | 10.0484 | 32.62 |
| 50 | 50 | 4.6841 | 10.0438 | 32.58 |
| 75 | 25 | 4.4 | 10.23 | 32.2 |
| 100 | 0 | 4.1816 | 10.7086 | 31.51 |

As shown in Table 3, all of the mixtures of light naphtha and heavy naphtha had a light naphtha content of at least 25 vol %. All of the mixtures had a measured chemical delay that was greater than the chemical delay of the heavy naphtha alone. Based on the values in Table 3, a curve was fit to the data to allow for extrapolation of the cetane number for the light naphtha fraction. FIG. 4 includes the equation for the curve fit determined based on the data. Extrapolation of the curve fit resulted in a cetane number for the light naphtha fraction of 29.4. This is lower than the 31.5 derived cetane number for the heavy naphtha fraction.

EXAMPLE 4

Additional Comparisons

In addition to mixtures of light naphtha with heavy naphtha, mixtures were also prepared corresponding to a) mixtures of light naphtha with a reference diesel, b) mixtures of ethanol with heavy naphtha, c) mixtures of gasoline with heavy naphtha, and d) mixtures of pentanes with heavy naphtha.

Table 4 shows results from mixing 0.25 vol % to 3 vol % of the light naphtha from Table 2 with the reference diesel from Table 2. As shown in Table 4, addition of light naphtha to the reference diesel resulted in increases in both the chemical delay and the physical delay at each of the concentrations relative to the reference diesel alone.

TABLE 4

Measured Ignition Delays for Light Naphtha and Diesel Blends

| Vol % Light Naphtha | Chemical Delay | Physical Delay | DCN |
|---|---|---|---|
| 3 | 3.5902 | 6.06 | 41.9 |
| 1 | 3.5251 | 5.992 | 42.17 |
| 0.5 | 3.5238 | 5.9797 | 42.23 |
| 0.25 | 3.594 | 6.0464 | 41.96 |
| 0 | 3.026 | 5.596 | 43.8 |

Table 5 shows results from mixing 0.1 vol % to 1 vol % of reagent grade ethanol with the heavy naphtha from Table 2. As shown in Table 5, addition of 0.1 vol % ethanol appeared to leave the ignition delay and derived cetane number basically unchanged. Further increases in the amount of ethanol added resulted in longer ignition delays and lower derived cetane number.

TABLE 5

Measured Ignition Delays for Ethanol and Heavy Naphtha Blends

| Ethanol Content (vol %) | Chemical Delay | Physical Delay | DCN |
|---|---|---|---|
| 1 | 4.2299 | 10.9365 | 31.22 |
| 0.5 | 4.1982 | 10.8781 | 31.29 |
| 0.1 | 4.1821 | 10.6654 | 31.57 |
| 0 | 4.1816 | 10.7086 | 31.51 |

Table 6 shows results from mixing 0.1 vol % to 5 vol % of the reference gasoline from Table 2 with the heavy naphtha from Table 2. As shown in Table 6, addition of up to about 0.5 vol % of the reference gasoline appeared to leave the ignition delay and derived cetane number relatively unchanged. Further increases in the amount of gasoline added resulted in longer ignition delays and lower derived cetane number.

TABLE 6

Measured Ignition Delays for Gasoline and Heavy Naphtha Blends

| Gasoline Conc. (Vol. %) | Chemical Delay | Physical Delay | DCN |
|---|---|---|---|
| 5 | 4.2551 | 11.1573 | 30.95 |
| 1 | 4.2114 | 10.8452 | 31.34 |
| 0.5 | 4.1879 | 10.7409 | 31.47 |
| 0.1 | 4.185 | 10.6819 | 31.54 |
| 0 | 4.1816 | 10.7086 | 31.51 |

Figure 5:
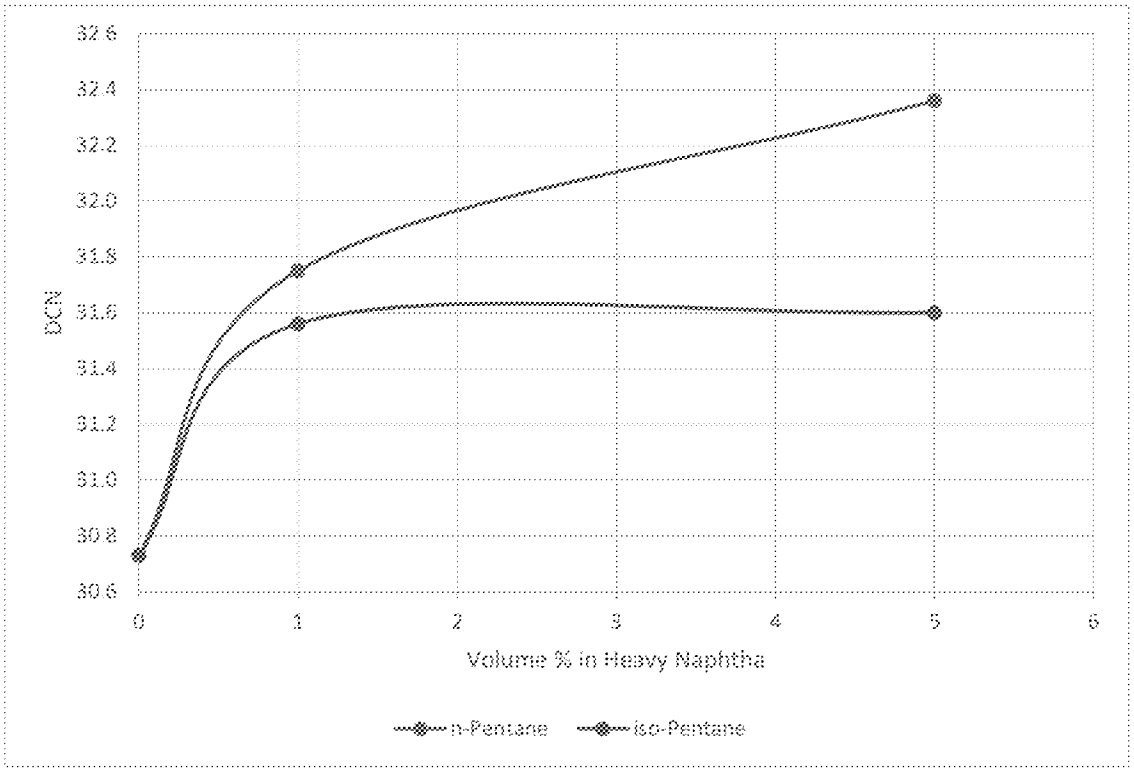
FIG. 5 shows derived cetane number values for various mixtures of pentanes with a heavy naphtha

Table 7 shows results from mixing 1 vol % or 5 vol % of either n-pentane or isopentane with the heavy naphtha from Table 2. Table 7 shows that addition of either type of pentane results in a decrease in ignition delay relative to the corresponding heavy naphtha. The derived cetane numbers in Table 7 are also shown in FIG. 5. FIG. 5 appears to show that while addition of both n-pentane and isopentane provide an initial increase in derived cetane number, addition of n-pentane provides further benefit when 5 vol % is added. For isopentane, the increase in cetane number is similar at 1 vol % and 5 vol %.

TABLE 7

Measured Ignition Delays for Pentane and Heavy Naphtha Blends

| | Heavy Naphtha | +1% n-Pentane | +5% n-Pentane | +1% iso-Pentane | +5% iso-Pentane |
|---|---|---|---|---|---|
| ID | 4.870 | 4.0095 | 3.9706 | 3.9715 | 4.0899 |
| CD | 11.472 | 10.4897 | 10.0499 | 10.6182 | 10.6216 |
| DCN | 30.7 | 31.75 | 32.36 | 31.56 | 31.6 |

Figure 6:
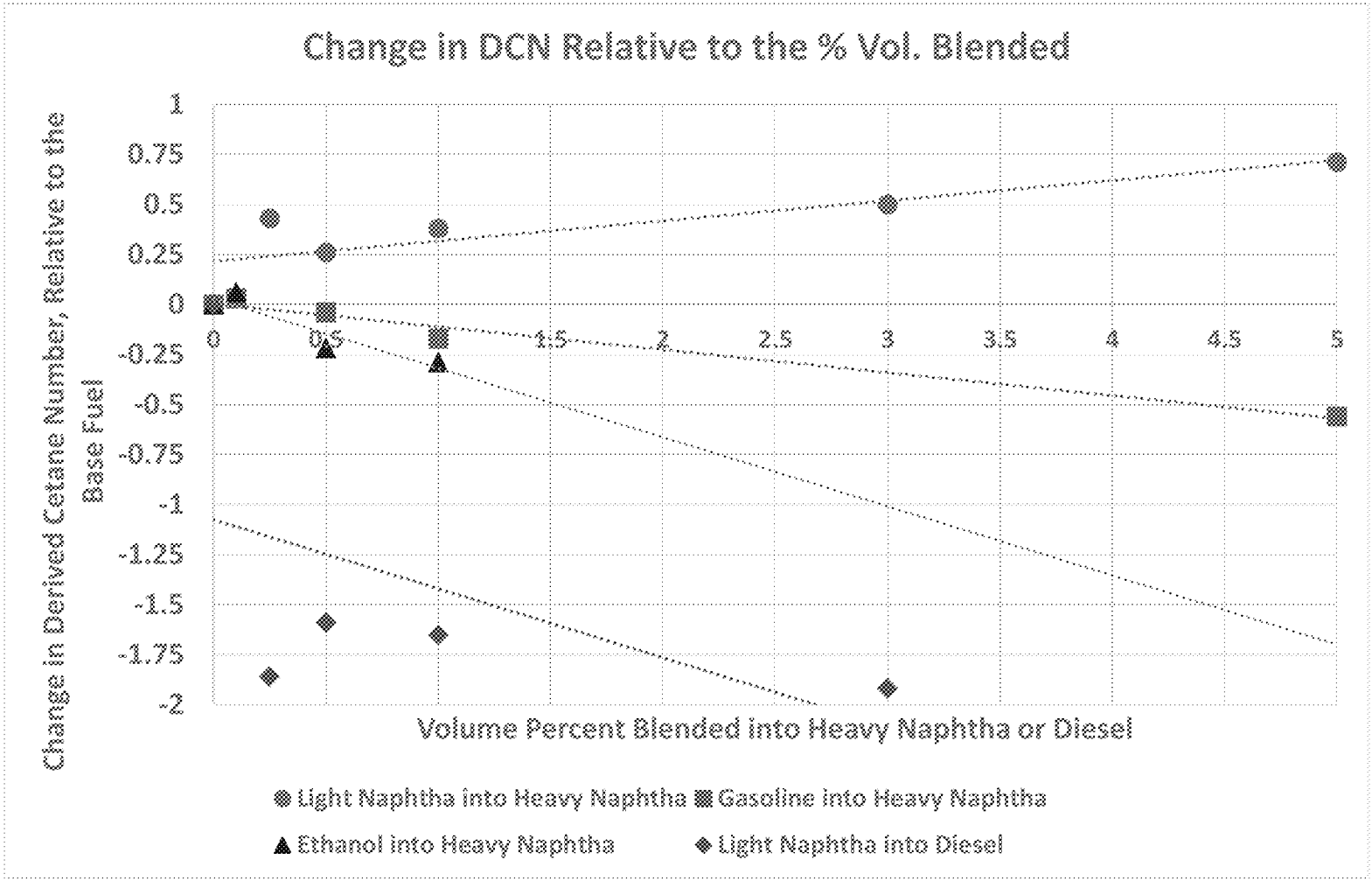
FIG. 6 shows derived cetane numbers for various fuel composition mixtures.

FIG. 6 provides a summary of the derived cetane number values shown in Tables 4-7. As shown in FIG. 6, only the addition of light naphtha to heavy naphtha provides the unexpected benefit where the addition of a lower derived cetane number fraction results in an increase in the derived cetane number of a mixture.

Additional Embodiments

Embodiment 1. A fuel composition comprising a derived cetane number of about 27 to about 43, the fuel composition comprising a T5 distillation point of about 20° C. to about 60° C., a T10 distillation point of about 50° C. to about 120° C., a T15 distillation point of about 90° C. to about 140° C., and a T95 distillation point of about 275° C. or less.

Embodiment 2. The fuel composition of Embodiment 1, wherein the T5 distillation point is about 20° C. to about 40° C., the T10 distillation point is about 50° C. to about 80° C., and the T15 distillation point is about 90° C. to about 120° C.; or wherein the T5 distillation point is about 30° C. to about 50° C., the T10 distillation point is about 60° C. to about 100° C., and the T15 distillation point is about 100° C. to about 140° C.; or wherein the T5 distillation point is about 40° C. to about 60° C., the T10 distillation point is about 70° C. to about 120° C., and the T15 distillation point is about 100° C. to about 140° C.

Embodiment 3. The fuel composition of Embodiment 1 or 2, wherein the T95 distillation point is about 204° C. or less, or wherein the T95 distillation point is about 204° C. to about 250° C., or about 204° C. to 232° C., or about 220° C. to about 250° C.

Embodiment 4. The fuel composition of any of the above embodiments, wherein the fuel composition has a derived cetane number of at least about 30.

Embodiment 5. The fuel composition of any of the above embodiments, wherein the fuel composition comprises a chemical delay, as determined by ASTM D7668, of 5.0 milliseconds or less, a physical delay of 8 milliseconds to 20 milliseconds, or a combination thereof.

Embodiment 6. A method for forming a fuel composition, comprising: mixing a first composition comprising a light naphtha portion with a second composition comprising a heavy naphtha portion to form the fuel composition, the fuel composition comprising a derived cetane number of 27 to 43, the fuel composition comprising 0.1 vol % to 10 vol % of the first composition, wherein the first composition has a T5 distillation point of at least about 10° C. and a T95 distillation point of about 110° C. or less, the second composition having a T5 distillation point of at least about 90° C. and a T95 distillation point of about 275° C. or less.

Embodiment 7. The method of Embodiment 6 or 7, wherein the fuel composition has a T5 distillation point of about 20° C. to about 40° C., a T10 distillation point of about 50° C. to about 80° C., and a T15 distillation point of about 90° C. to about 120° C.; or wherein the T5 distillation point is about 30° C. to about 50° C., the T10 distillation point is about 60° C. to about 100° C., and the T15 distillation point is about 100° C. to about 140° C.; or wherein the fuel composition has a T5 distillation point of about 40° C. to about 60° C., a T10 distillation point of about 70° C. to about 120° C., and a T15 distillation point of about 100° C. to about 140° C.

Embodiment 8. The method of Embodiment 6 or 7, wherein the fuel composition comprises 1.0 vol % to 10 vol % of the first composition, or 1.0 vol % to 5.0 vol %, or 3.0 vol % to 10 vol %, or 3.0 vol % to 5.0 vol %.

Embodiment 9. The method of Embodiment 6 or 7, wherein the fuel composition comprises 0.1 vol % to 3.0 vol % of the first composition, or 0.1 vol % to 2.0 vol %, or 0.1 vol % to 1.0 vol %.

Embodiment 10. The method of Embodiment 6 or 9, wherein the fuel composition has a T5 distillation point of at least about 90° C., or at least about 100° C.

Embodiment 11. The method of any of Embodiments 6-10, wherein the T95 distillation point is about 204° C. or less, or wherein the T95 distillation point is about 204° C. to about 250° C., or about 204° C. to 232° C., or about 220° C. to about 250° C.

Embodiment 12. The method of any of Embodiments 6-11, wherein the fuel composition has a derived cetane number of at least about 30.

Embodiment 13. The method of any of Embodiments 6-12, wherein the first composition has an aromatics content of about 10 vol % or less and the second composition has an aromatics content of about 15 vol % to about 40 vol %.

Embodiment 14. The method of any of Embodiments 6-13, wherein the fuel composition has a chemical delay as determined by ASTM D7668 of less than 5.0 milliseconds, a physical delay of 8 milliseconds to 20 milliseconds, or a combination thereof.

Embodiment 15. The method of any of Embodiments 6-14, wherein the fuel composition has a chemical delay as determined by ASTM D7668 that is less than a chemical delay of the second composition.

Embodiment 16. A fuel composition made according to the method of any of Embodiments 6-15.

Embodiment 17. The fuel composition of any of Embodiments 1-5 or 16, the fuel composition further comprising an additive.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

The invention claimed is:

1. A fuel composition comprising a derived cetane number of about 27 to about 43 as measured by ASTM test procedure D7668-14A, and wherein the fuel composition includes from about 0.25 vol. % to less than or equal to about 10 vol. % of light naphtha in heavy naphtha and has a chemical delay, as determined by ASTM 7688, of 4.70 milliseconds or less.

2. The fuel composition of claim 1, wherein the fuel composition includes from about 0.25 vol. % to less than or equal to about 3 vol. % of light naphtha in heavy naphtha and has a chemical delay, as determined by ASTM 7688, of 4.51 milliseconds or less.

3. The fuel composition of claim 1, wherein the fuel composition has a derived cetane number of at least about 30.

4. The fuel composition of claim 1, wherein the fuel composition includes from about 0.25 vol. % to less than or equal to about 1 vol. % of light naphtha in heavy naphtha and has a chemical delay, as determined by ASTM 7688, of 4.51 milliseconds or less.

5. The fuel composition of claim 1, wherein the fuel composition further comprises at least one additive.

6. A method for forming a fuel composition, comprising:

mixing a first composition comprising a light naphtha portion with a second composition comprising a heavy naphtha portion to form the fuel composition, the fuel composition comprising a derived cetane number of 27 to 43 as measured by ASTM test procedure D7668-14A , the fuel composition comprising 0.25 vol % to 10 vol % of the first composition, and wherein the fuel composition has a chemical delay, as determined by ASTM 7688, of 4.70milliseconds or less.

7. The method of claim 6, wherein the fuel composition comprises 0.25 vol % to 3.0 vol % of the first composition, and has a chemical delay, as determined by ASTM 7688, of 4.51 milliseconds or less.

8. The method of claim 7, wherein the fuel composition includes from 0.25 vol. % to 1 vol. % of the first composition and has a chemical delay, as determined by ASTM 7688, of 4.51 milliseconds or less.

9. The method of claim 6, wherein the fuel composition comprises 0.25 vol % to 0.50 vol % of the first composition and has a chemical delay, as determined by ASTM 7688, of 4.46 milliseconds or less.

10. The method of claim 9, a) wherein the fuel composition has a T5 distillation point of about 20° C. to about 40° C., a T10 distillation point of about 50° C. to about 80° C., and a T15 distillation point of about 90° C. to about 120° C., or b) wherein the T5 distillation point is about 30° C. to about 50° C., the T10 distillation point is about 60° C. to about 100° C., and the T15 distillation point is about 100° C. to about 140° C., or c) wherein the fuel composition has a T5 distillation point of about 40° C. to about 60° C., a T10 distillation point of about 70° C. to about 120° C., and a T15 distillation point of about 100° C. to about 140° C.

11. The method of claim 6, wherein the T95 distillation point is about 204° C. or less.

12. The method of claim 6, wherein the T95 distillation point is about 204° C. to about 250° C.

13. The method of claim 6, wherein the fuel composition has a derived cetane number of at least about 30.

14. The method of claim 6, wherein the first composition has an aromatics content of about 10 vol % or less and the second composition has an aromatics content of about 15 vol % to about 40 vol %.

15. The method of claim 6, wherein the fuel composition has a physical delay of 10.85 milliseconds to 11.17 milliseconds.

16. The method of claim 6, wherein the fuel composition has a chemical delay as determined by ASTM D7668 that is less than a chemical delay of the second composition.

* * * * *